United States Patent [19]

Oliff

[11] Patent Number: 5,000,313

[45] Date of Patent: Mar. 19, 1991

[54] CAN CARTON

[75] Inventor: James R. Oliff, Austell, Ga.

[73] Assignee: The Mead Corporation, Dayton, Ohio

[21] Appl. No.: 530,163

[22] Filed: May 29, 1990

[51] Int. Cl.[5] ..... B65D 75/00

[52] U.S. Cl. ..... 206/140; 206/427; 206/434; 229/40

[58] Field of Search ..... 206/139, 140, 141, 427, 206/428, 429, 434; 229/40

[56] References Cited

U.S. PATENT DOCUMENTS

| | | | |
|---|---|---|---|
| 2,832,182 | 4/1958 | McGihon | 206/434 |
| 2,889,040 | 6/1959 | Fisher | 206/427 |
| 2,931,490 | 4/1960 | McGihon | 206/427 |
| 2,936,069 | 5/1960 | Dunning | 206/427 |
| 2,943,427 | 7/1960 | Fisher | 206/434 |
| 3,146,885 | 9/1964 | Hughes | 206/429 |
| 3,381,816 | 5/1968 | Forrer | 206/140 |
| 3,410,397 | 11/1968 | Cato | 206/140 |
| 3,578,238 | 5/1971 | Schillinger | 206/427 |
| 3,680,765 | 8/1972 | Harrelson | 206/140 |
| 3,701,181 | 10/1972 | Lock | 206/434 |
| 3,797,729 | 3/1974 | Holmes | 229/40 |
| 4,216,861 | 8/1980 | Oliff | 206/427 |
| 4,364,509 | 12/1982 | Holley, Jr. et al. | 206/141 |
| 4,533,047 | 8/1985 | Calvert | 206/434 |
| 4,574,997 | 3/1986 | Ikeda | 206/434 |
| 4,577,799 | 3/1986 | Oliff | 206/427 |
| 4,637,515 | 1/1987 | Wilson et al. | 206/141 |
| 4,732,316 | 3/1988 | Oliff et al. | 206/427 |
| 4,785,991 | 11/1988 | Schuster | 206/141 |

FOREIGN PATENT DOCUMENTS

| | | | |
|---|---|---|---|
| 580540 | 7/1959 | Canada | 206/141 |
| 1340792 | 12/1973 | United Kingdom | 206/427 |

*Primary Examiner*—David T. Fidei

*Attorney, Agent, or Firm*—Rodgers & Rodgers

[57] ABSTRACT

A plurality of cans each having a cylindrical side wall and inwardly recessed bottom and top portions, the carton including a top wall, a first pair of continuous uninterrupted bevel strips foldably joined to the side edges of the top wall, side walls foldably joined along their top edges respectively to the first pair of bevel strips, a second pair of continuous uninterrupted bevel strips foldably joined respectively along the bottom edges of the side walls, a pair of lap panels foldably joined respectively along the bottom edges of the second pair of bevel strips and secured together in overlapping relation, an anchoring panel foldably joined to each end edge of each side wall and folded into flat face contacting relation with the inner surface of the associated side wall, and web structure foldably joined to each end of each of the anchoring panels and to the adjacent corner of the top wall and of the composite bottom wall, the web structures being respectively disposed astride the corners of the carton and in engagement with the adjacent cans to prevent dislodgement of the cans from the carton.

8 Claims, 4 Drawing Sheets

CAN CARTON

TECHNICAL FIELD

This invention relates to packaging a plurality of cylindrical cans each having inwardly recessed top and bottom side wall portions in an open ended carton structure.

BACKGROUND ART

U.S. Pat. No. 2,849,111 issued Aug. 26, 1958 discloses a carton for packaging a plurality of cans which includes web structure astride the carton corners for engaging and retaining packaged cans against dislodgement through the open ends of the carton.

U.S. Pat. No. 4,093,116 issued June 6, 1978 and owned by the assignee of this invention discloses a wrap around carton for packaging cans in which bottle engaging apertures are formed at the corners of the carton for receiving parts of the packaged cans thereby to prevent dislodgement of the cans through the open ends of the wrapper.

U.S. Pat. No. 4,735,315 issued Apr. 5, 1988 and owned by the assignee of this invention discloses a can carton whose ends are closed by end flaps which are secured together in conventional fashion so as to prevent dislodgement of the cans through the ends of the carton. This patent also discloses an upwardly and outwardly inclined bevel strip disposed alongside inwardly and downwardly inclined circular connecting structure forming the lower end portions of the packaged cans thereby to eliminate square corners at the bottom of the carton and the resulting tendency of the end walls of the carton to bow outwardly when stacked in tiers one above the other.

SUMMARY OF THE INVENTION

According to this invention in one form, a can carton is provided which is specially adapted for packaging a plurality of cylindrical cans each having an inwardly recessed configuration about the bottom and top edges of the side walls and wherein the carton includes a top wall, a first pair of continuous uninterrupted bevel strips foldably joined to the side edges of the top wall, side walls foldably joined along their top edges respectively to said first pair of bevel strips, a second pair of continuous uninterrupted bevel strips foldably joined respectively along the bottom edges of said side walls, a pair of lap panels foldably joined respectively along the bottom edges of said second pair of bevel strips and secured together in overlapping relation to form a composite bottom wall of the carton, an anchoring panel foldably joined to each end edge of each side wall and folded into flat face contacting relation with the inner surface of the associated side wall, and web structure foldably joined to each end of each of said anchoring panels and to adjacent corners of said top and bottom walls, said web structures being respectively disposed astride the carton corners and in engagement with the adjacent articles to prevent dislodgement of the articles from the carton and each web structure including a pair of web panels foldably joined together along a fold which is disposed in divergent relation to the associated fold line between the top wall and the top edge of the associated bevel strip.

According to one form of the invention, an end panel is foldably joined to each end edge of the top wall and interconnected by a web panel foldably joined to each end edge of each end panel and to the adjacent end of the adjacent anchoring panel.

BEST MODE OF CARRYING OUT THE INVENTION

Figure 1:
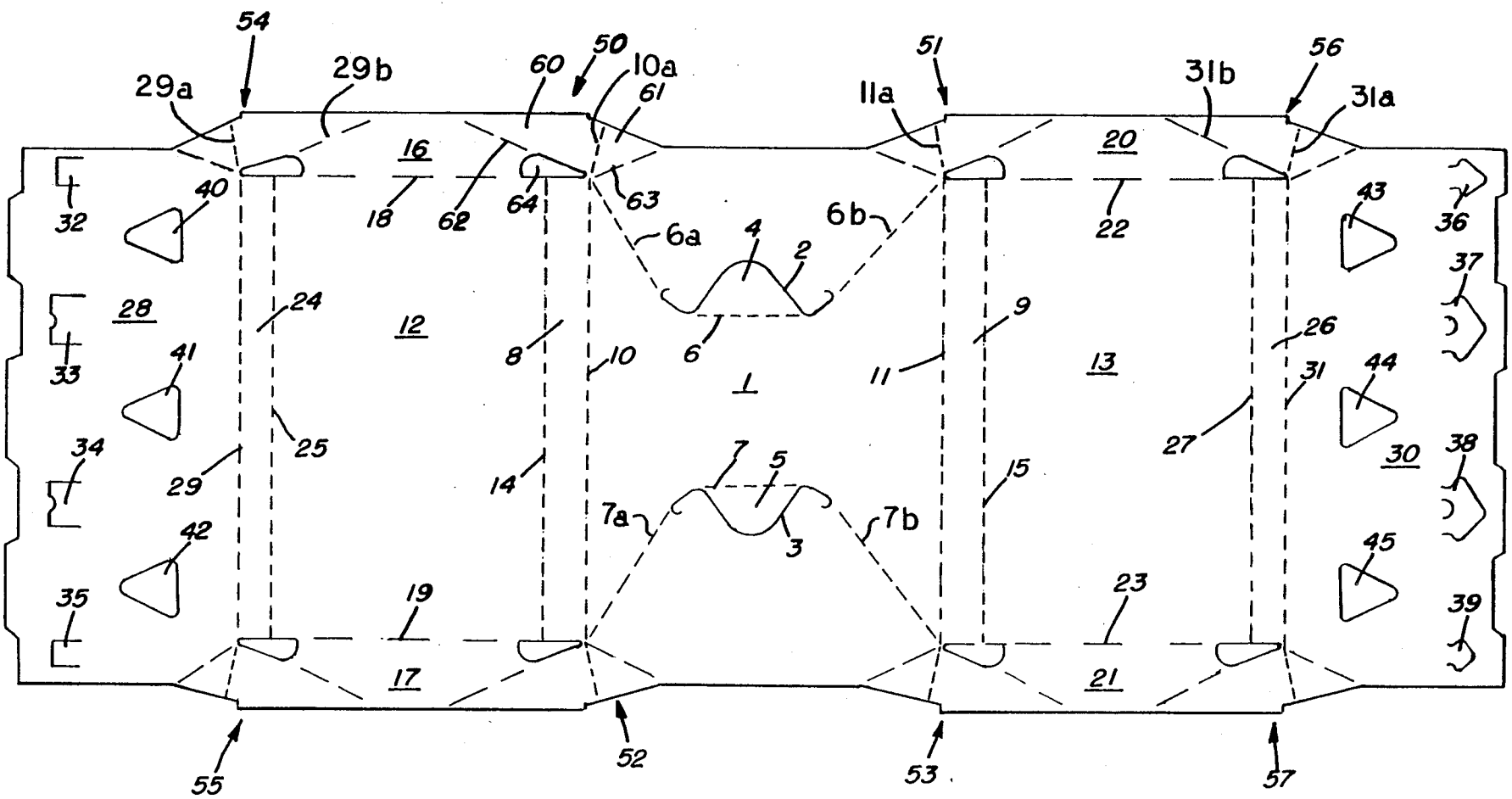
FIG. 1 is a plan view of a blank formed according to the invention as viewed from the inside thereof.

With reference primarily to FIG. 1, the numeral 1 designates the carton top wall. A pair of finger receiving apertures 2 and 3 are formed in top wall 1 and are normally closed by tabs 4 and 5 which are foldably joined to top wall 1 along fold lines 6 and 7 respectively. A pair of relief scores **6*a* and 6*b* are formed in association with the finger receiving aperture 2 and which diverge generally toward the top wall corner and similar relief scores 7*a* and 7*b* are also provided. A pair of continuous uninterrupted bevel strips 8 and 9 are foldably joined to top wall 1 along fold lines 10 and 11 respectively. Fold lines 10 and 11 are provided with divergent extensions which are angularly disposed relative to such fold lines and are identified by the references 10*a* and 11*a*. Side walls 12 and 13 are foldably joined to bevel strips 8 and 9 along fold lines 14 and 15 respectively. Anchoring panels 16 and 17 are foldably joined to end edges of side wall 12 along fold lines 18 and 19 respectively while anchoring panels 20 and 21 are foldably joined to the end edges of side wall 13 along fold lines 22 and 23** respectively.

Bevel strip 24 is foldably joined to the bottom edge of side wall 12 along a fold line 25 and bevel strip 26 is foldably joined to the bottom edge of side wall 13 along a fold line 27.

Preferably bevel strips 8 and 9 are slightly wider than bevel strips 24 and 26.

Bottom lap panel 28 is foldably joined to the bottom edge of bevel strip 24 along fold line 29 and bottom lap panel 30 is foldably joined to the bottom edge of bevel strip 26 along fold line 31.

For securing the packaged cans in a composite package group within the carton, the carton blank is placed above a package group and the anchoring panels 16, 17, 20 and 21 are folded inwardly into flat face contacting relation with the adjacent inner surface of side walls 12 and 13 as is obvious. Web structures generally indicated at 50 and 51, 52 and 53 are disposed astride the upper corners of the carton and prevent dislodgement of cans through the ends of the carton as the known folding applications are preformed. In like fashion, web structures 54, 55, 56 and 57 are disposed astride the bottom corners of the carton and aid in securing the cans against dislodgement through the ends of the wrapper.

For securing the lap panels 28 and 30 together in overlapping relation, a plurality of retaining tabs 32, 33, 34 and 35 are struck from lap panel 28 to define apertures for respectively receiving locking tabs 36, 37, 38 and 39 which are struck from lap panel 30. These locking tabs are driven through the openings defined by retaining tabs 32–35 after the blank is securely tightened about a group of packaged cans by means of machine elements which enter tightening apertures 40, 41 and 42 formed in lap panel 28 and by similar machine tightening elements which enter apertures 43, 44 and 45 formed in lap panel 30 and which are drawn inwardly in opposition to machine elements disposed within tightening apertures 40, 41 and 42 to tighten the blank about a packaged group before locking of the lap panels 28 and 30 together in flat face contacting relation to form a composite bottom wall of the carton.

Each web structure comprises a pair of web panels such as 60 and 61 which are foldably joined together by divergent extensions 10*a* and 11*a* respectively which diverge inwardly by an angle which corresponds generally with the angle of taper of the inwardly inclined upper portions of the side wall. Web panel 60 is foldably joined to an end of anchoring panel 16 along fold line 62 and web panel 61 is foldably joined to top wall 1 along fold line 63 which is disposed tangentially to the top of the can. Fold lines 62 and 63 are preferably disposed at an angle of 120 degrees to each other. A cutaway area designated by the numeral 64 serves to isolate the web panel 60 from the bevel strip 81. Web structure according to that described in conjunction with web structure 50 also forms web structures 51–57 as is obvious.

Fold lines 29*a* and 31*a* correspond to fold lines 10*a* and 11*a* respectively and folds 29*b* and 31*b* correspond to fold lines 62.

Figure 2:
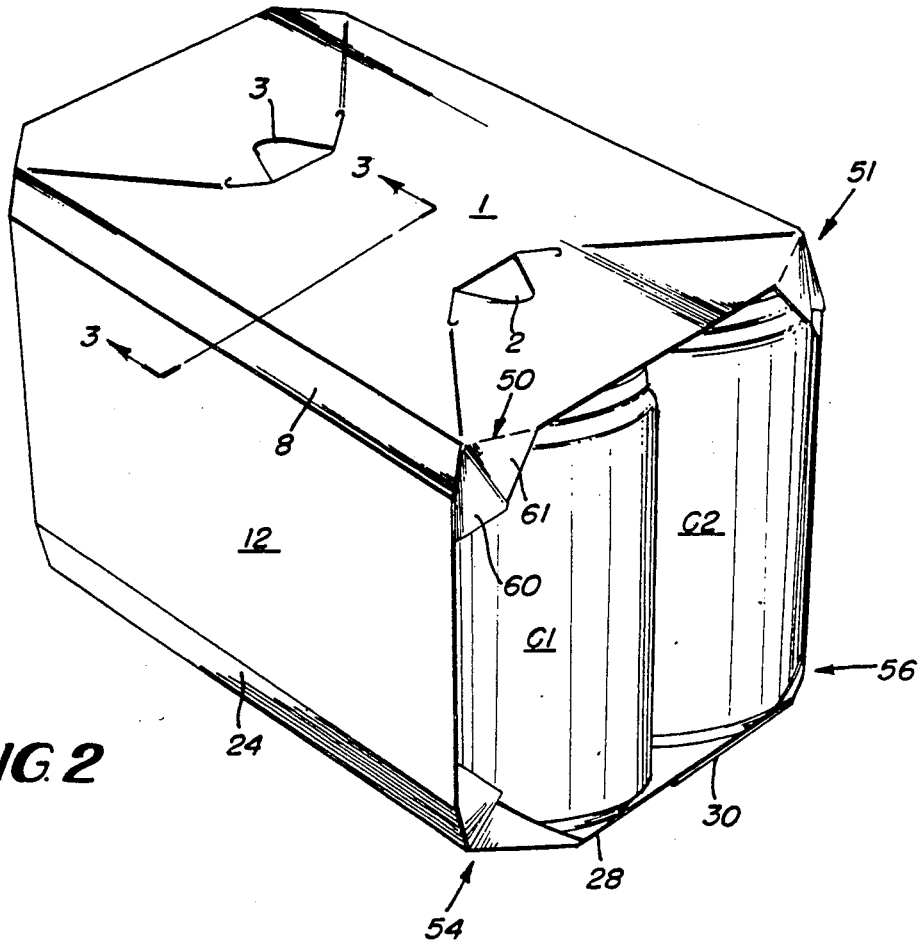
FIG. 2 is a perspective view of a set up and fully loaded carton employing the blank of FIG. 1.

When the wrapper of FIG. 1 is disposed about a can group such as is shown in FIG. 2, the bevel strips 8 and 24 snugly engage the inwardly recessed parts such as IR of the packaged cans and thus contribute toward the formation of a compact and secure carton which accommodates the particular configuration of the packaged cans and which also affords an attractive exterior appearance of the carton as is obvious from FIG. 2. Furthermore, the web structures such as 50, 51, 54 and 56 are disposed astride the carton corners and securely grip the packaged cans and prevent dislodgement of the cans through the ends of the carton. Similar web structures 52, 53, 55 and 57 secure the opposite end of the carton.

Figure 4:
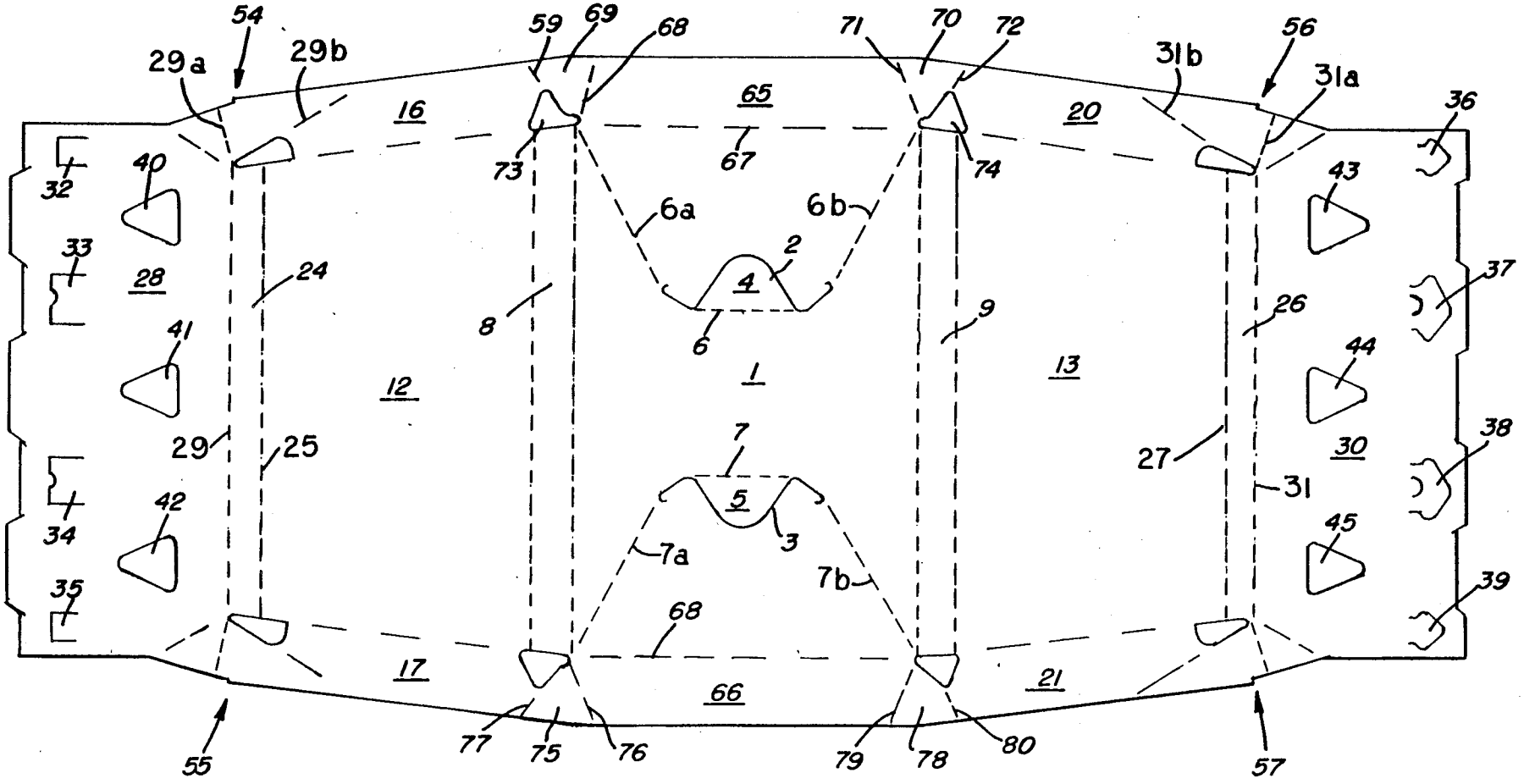
FIG. 4 is a view similar to FIG. 1 but which shows a modification of FIG. 1 wherein end panels are foldably joined to the end edges of the carton top wall.

The blank shown in FIG. 4 is similar to the blank of FIG. 1 and parts which correspond to the parts of FIG. 1 are identified by the same reference numerals. The blank of FIG. 4 unlike the blank of FIG. 1 includes end panels 65 and 66 which are foldably joined respectively to top wall 1 along fold lines 67 and 68 instead of web structure comprising two web panels at the corners of top wall 1, a single web panel 69 is foldably joined to one end of end panel 65 along fold line 68 and to the adjacent end of anchoring panel 16 along fold line 59. In like fashion, a single triangular web panel 70 is foldably joined to end panel 65 along fold line 71 and to anchoring panel 20 along fold line 72. A cutaway portion 73 is formed adjacent the end edge of bevel strip 8 and a similar cutaway area 74 is formed adjacent an end of bevel strip 9. These cutaway areas 73 and 74 serve to isolate the adjacent ends of bevel strips 8 and 9 from the web panels 69 and 70 respectively.

At the other end of the carton, a single web panel 75 is foldably joined along fold line 76 to one end of end panel 66 and to the adjacent end 77 of anchoring panel 17. In like fashion, a single web panel 78 is foldably joined to an end of end panel 66 along fold line 79 and to the adjacent end of anchoring panel 21 along fold line 80.

Figure 5:
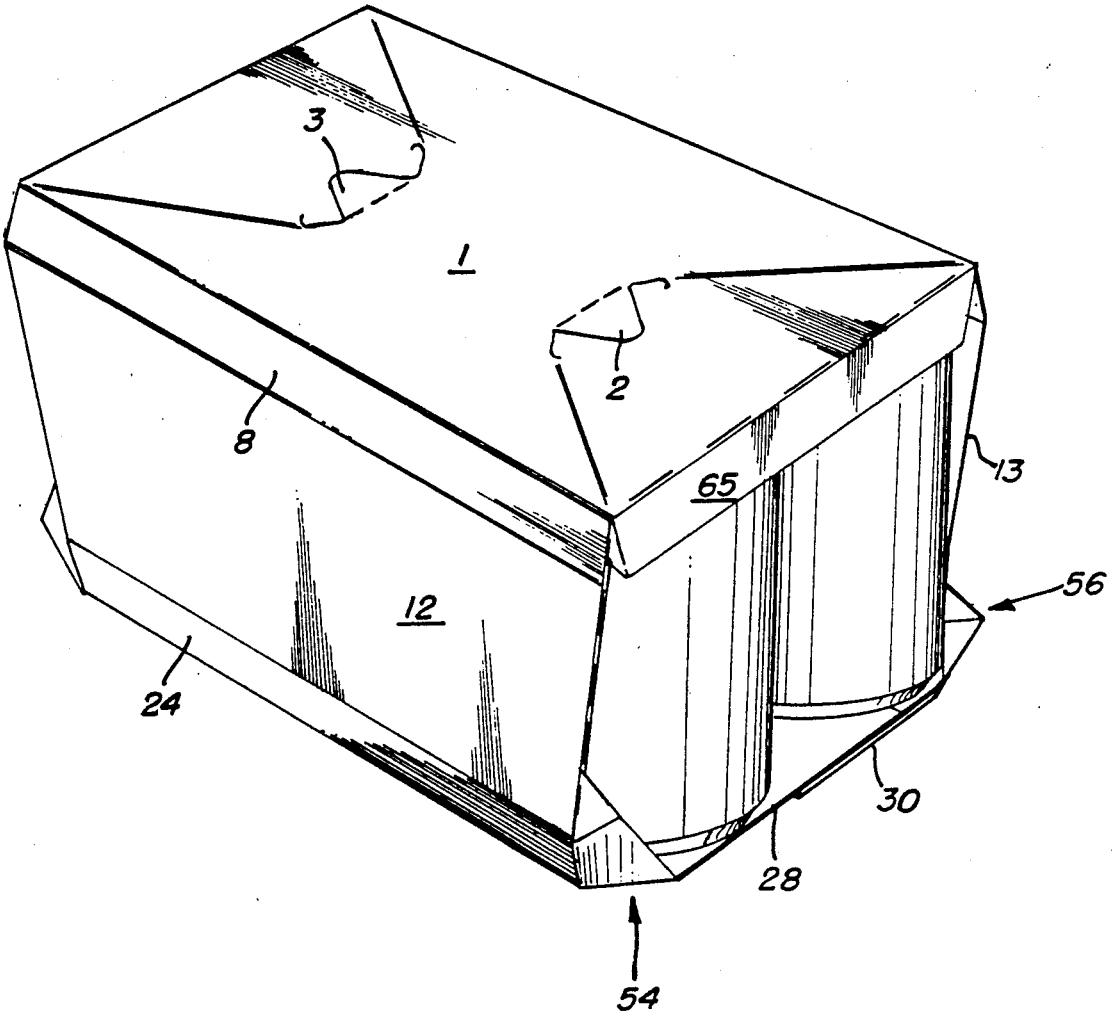
FIG. 5 is a view similar to FIG. 2 and shows a set up and fully loaded carton formed by the blank of FIG. 4.

The blank of FIG. 4 when set up results in a package as shown in perspective in FIG. 5. The end panels 65 and 66 add to the security of the package and also constitute usable billboard space if such is desired.

Figure 3:
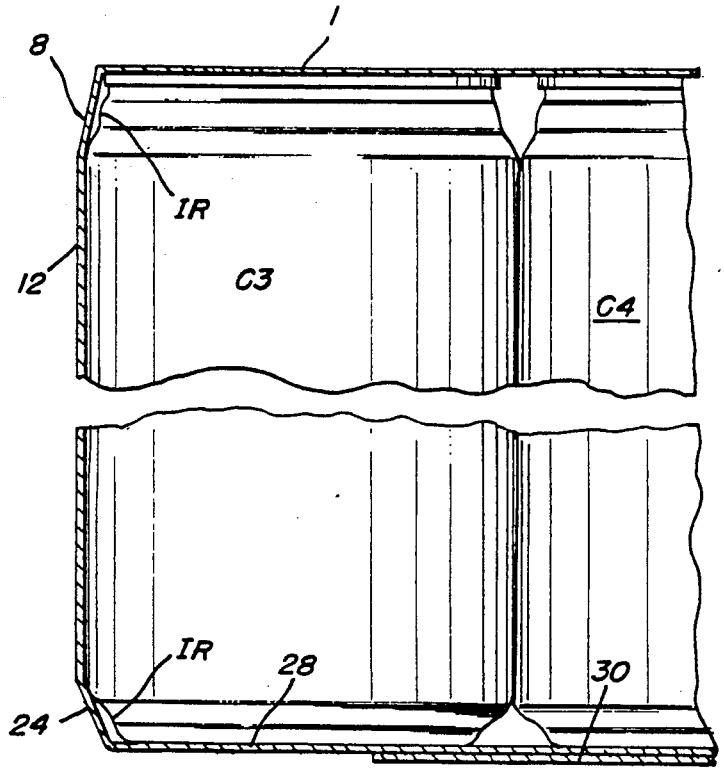
FIG. 3 is an enlarged partial cross sectional view taken along the line designated 3—3 in FIG. 2.

According to this invention, a secure and compact package is provided which is specially adapted for use in connection with cans which include inwardly recessed top and bottom portions as best shown and identified IR in FIG. 3 and which provide appropriate can retention means without using can retention apertures formed in bevel strips 8, 9, 24 and 26 or which in some instances are formed in a top and bottom portion of the carton side walls to serve as means for retaining the cans against dislodgement through the ends of the wrapper. Thus by the invention, security is provided in the formation of a compact package which is specially adapted for use with cans having inwardly recessed top and bottom portions and which affords an attractive and secure compact package group.

I claim:

1. A carton formed from a unitary blank for packaging a plurality of cans each having a cylindrical side wall and inwardly tapered recessed bottom and top portions, said carton comprising a top wall, a first pair of continuous uninterrupted bevel strips foldably joined to the side edges of said top wall, side walls foldably joined along their top edges respectively to said first pair of bevel strips, a second pair of continuous uninterrupted bevel strips foldably joined respectively along the bottom edges of said side walls, a pair of lap panels foldably joined respectively along the bottom edges of said second pair of bevel strips and secured together in overlapping relation to form a composite bottom wall of the carton, an anchoring panel foldably joined to each end edge of each side wall and folded into flat face contacting relation with the inner surface of the associated side wall, and web structure foldably joined to each end of each of said anchoring panels and to the adjacent corner of said top wall and of said composite bottom wall, said web structures comprising web panels foldably joined by a divergent extension of the side edge of the adjacent top or bottom wall and being respectively disposed astride the corners of the carton and in engagement with the adjacent cans to prevent dislodgement of the cans from the carton.

2. A carton according to claim 1 wherein the fold lines adjoining said web structures to said adjacent corner of said top wall and the associated anchoring panel being disposed at an angle of approximately 120 degrees to each other.

3. A carton according to claim 1, wherein each of said anchoring panels is cutaway at upper and lower parts thereof so as to isolate said anchoring panels from the adjacent end of an adjacent bevel strip.

4. A carton according to claim 1 wherein the bevel strips of said first pair of bevel strips are slightly wider than said second pair of bevel strips thereby to facilitate conformation of the carton to the configuration of the cans thereby to aid in forming a compact and secure package.

5. A carton according to claim 1 wherein an end panel is foldably joined to each end edge of said top wall and wherein the ends of each of said end panels are foldably joined respectively to web panels along fold lines which diverge inwardly from the side edges of said top wall.

6. A carton according to claim 5 wherein each of said web panels is foldably joined to the adjacent end of the associated anchoring panel.

7. A carton according to claim 6 wherein each of said web panels is of triangular configuration.

8. A carton according to claim 1 wherein said divergent extensions of said side edges of said adjacent top or bottom wall diverge inwardly by an angle which corresponds generally with the angle of taper of the inwardly tapered recessed upper and lower portions of said side walls of the packaged cans.

* * * * *

UNITED STATES PATENT AND TRADEMARK OFFICE

CERTIFICATE OF CORRECTION

PATENT NO. : 5,000,313

DATED : March 19, 1991

INVENTOR(S) : James R. Oliff

It is certified that error appears in the above-identified patent and that said Letters Patent is hereby corrected as shown below:

Column 2, line 61 cancel "preformed" and substitute - performed -

Signed and Sealed this

Twenty-fifth Day of August, 1992

*Attest:*

DOUGLAS B. COMER

*Attesting Officer*

*Acting Commissioner of Patents and Trademarks*